United States Patent [19]

Haupenthal

[11] Patent Number: 4,735,142

[45] Date of Patent: Apr. 5, 1988

[54] SHEET TRANSFER DRUM

[75] Inventor: Rudi Haupenthal, Epfenbach, Fed. Rep. of Germany

[73] Assignee: Heidelberger Druckmaschinen AG, Heidelberg, Fed. Rep. of Germany

[21] Appl. No.: 915,754

[22] Filed: Oct. 6, 1986

[30] Foreign Application Priority Data

Oct. 5, 1985 [DE] Fed. Rep. of Germany ..... 3535621

[51] Int. Cl.[4] ..... B41F 21/06; B41F 21/10; B41L 21/08

[52] U.S. Cl. ..... 101/246; 101/410; 101/420; 101/136; 101/183; 271/206; 271/276

[58] Field of Search ..... 101/183, 184, 246, 409, 101/410, 420; 271/82, 206, 277, 276

[56] References Cited

U.S. PATENT DOCUMENTS

| | | | |
|---|---|---|---|
| 1,107,254 | 8/1914 | Blackford | 101/410 |
| 3,642,274 | 2/1972 | Herrington et al. | 271/277 X |
| 4,378,734 | 4/1983 | Wirz | 101/410 X |
| 4,608,925 | 9/1986 | Arlt | 101/420 X |

FOREIGN PATENT DOCUMENTS

| | | | |
|---|---|---|---|
| 1230314 | 4/1971 | United Kingdom | 101/183 |

*Primary Examiner*—Clifford D. Crowder
*Attorney, Agent, or Firm*—Herbert L. Lerner; Laurence A. Greenberg

[57] ABSTRACT

Sheet transfer drum located between two printing units of a multicolor sheet-fed rotary printing press and having a cylindrical surface formed of a plurality of sheet-carrying elements arranged in succession around the circumference of the drum, including a suction means applicable to the trailing edge of a sheet of paper to be printed, mountings located at ends of the sheet transfer drum for carrying the sheet to be printed, each of the end mountings being formed by a respective guide channel oriented in circumferential direction of the sheet transfer drum, the guide channel having a radially outer portion and a radially farther inward portion, at least the outer of the radial portions being substantially equal in length to a maximum format of the sheet.

14 Claims, 5 Drawing Sheets

SHEET TRANSFER DRUM

SPECIFICATION

The invention relates to a sheet transfer drum which is located between printing units of a multicolor sheet-fed rotary printing press and having a cylindrical drum surface formed of a number of sheet-carrying elements arranged in succession around the circumference of the drum.

In the case of sheet-fed rotary printing presses arranged in series or tandem, three sheet transfer drums, for example, are positioned between the individual printing units in order to transport the sheet of paper to the next following printing unit. The second, i.e. the middle sheet transfer drum of the three, generally has twice the circumference of the other drums, thereby making it suitable for accepting two sheets at one and the same time.

In addition, with regard to the trailing edge of a sheet of paper to be conveyed, appropriately arranged suction devices are provided in order to prevent the sheet from dropping forward and sliding over the second sheet transfer drum as the sheet is being transferred to the next sheet transfer drum. This would otherwise result in a smearing of the printed image.

If the reverse side of a sheet is printed on first form and perfector printing presses in a printing unit, the freshly printed side of the sheet comes into contact with the surface of the middle sheet transfer drum. In such an instance, for example, so-called rowels located on rod-like longitudinal guides act as supporting elements, the points of which support the sheet at locations thereof where no printing has been applied, the rowels being movable along these longitudinal guides in order to ensure contact with non-printed sections of the sheet. The longitudinal guides themselves are inserted into holes drilled into the ends of the drum casing at regular intervals.

The suction devices assigned to the trailing edge of the sheet are mounted on two adjacent longitudinal guides and are also movable along these guides in a longitudinal direction.

In order to readjust the sheet transfer drum of such a configuration so that it can accept a sheet of a different size or format, in which case, of course, the suction devices also have to be readjusted in stages, it was necessary to reposition each of the rod-like longitudinal guides separately together with the related rowels and suction devices. All in all, this process is very time-consuming and labor-intensive.

A major disadvantage, therefore, lies in the long set-up time when changing the sheet size or format, which becomes all the more serious when considering the present-day structure of printing jobs, wherein the time required to set up the presses between printing jobs takes on an even increasing significance.

If the aforementioned sheet transfer drum is furnished with a closed cylindrical casing e.g. with a sheetmetal casing, because support of the sheet only at given points has not been required, then the aforementioned suction devices are practically useless, because it is almost impossible to adjust them to match other sheet sizes or formats.

It is accordingly an object of the invention to provide a sheet transfer drum which will permit a rapid change-over to different sheet sizes or formats and, in particular, will permit a corresponding rapid realignment of the suction devices to suit the new size format.

With the foregoing and other objects in view, there is provided, in accordance with the invention, a sheet transfer drum located between two printing units of multicolor sheet-fed rotary printing press and having a cylindrical surface formed of a plurality of sheet-carrying elements arranged in succession around the circumference of the drum, including a suction means applicable to the trailing edge of a sheet of paper to be printed, mountings located at ends of the sheet transfer drum for carrying the sheet to be printed, each of the end mountings being formed by a respective guide channel oriented in circumferential direction of the sheet transfer drum, the guide channel having a radially outer portion and a radially farther inward portion, at least the outer of the radial portions being substantially equal in length to a maximum format of the sheet. The main benefit achieved with this construction is the provision of a very flexible surface of the casing and a resulting ability to adjust the flexible surface easily and in an infinitely variable manner in order to accommodate the different sizes or formats of sheets to be printed. Thus, it is possible to reduce considerably the downtimes of the machine when changing over to a new printing job. Furthermore, complicated assembly work can be dispensed with without impairing the precise and smear-free transport of the sheet.

In accordance with another feature of the invention, the guide channel is formed in a bearing disc, and the portion of the guide channel located farther radially inwardly is joined to the radially outer portion thereof via a connecting channel, a shaft supporting the sheet transfer drum and formed with respective bearing seats whereon the respective bearing discs are mounted, a respective end bracket also located on each baring seat, a cross member extending through a concentric channel formed in the respective bearing discs and mutually connecting both of the end brackets, the cross member having entrainer lugs engaging around the sheet-carrying elements which are formed as guide rods.

With the foregoing and other objects in view, there is provided, in accordance with the invention, a sheet transfer drum located between two printing units of a multicolor sheet-fed rotary printing press and having a cylindrical drum surface formed of a plurality of sheet-carrying elements arranged in succession around the circumference of the drum, including mountings located at ends of the sheet transfer drum for carrying a sheet to be printed, each of the end mountings being formed by a respective guide channel oriented in circumferential direction of the sheet transfer drum with a length substantially equal to a maximum format of the sheet to be printed, a chain received in the guide channel and having at spaced intervals thereon protruding chain pins provided with spacer bushings and mounted in a guide groove of the guide channel, and guide rods carried by the chain and extending over the length of the sheet transfer drum, the guide rods being fitted with the sheet-carrying elements, the chain having a length also substantially equal to the maximum format of the sheet to be printed.

In accordance with a further feature of the invention there are provided small electric motors for driving the chains, respective pairs of the chain pins serving to support a mounting strap and engaging in respective recesses formed in the mounting straps, the mounting strap being also formed with receiving bores serving to receive the guide rods therein.

In accordance with an additional feature of the invention, the suction means comprise a plurality of suction devices assigned to the respective trailing edge of the sheet, and including mounting plates supporting the suction devices, the mounting plates being supported, in turn, on a respective adjacent pair of the guide rods so as to be displaceable in longitudinal direction thereon.

In accordance with an added feature of the invention, a plurality of longitudinally displaceable and rotatable rowels are mounted on the guide rods for supporting the paper sheet only on an array of points.

In accordance with yet another feature of the invention, the sheet-carrying elements comprise casing segments in surface area contact with the paper sheet for supporting the paper sheet, the casing segment being longitudinally displaceable through the intermediary of respective brackets and bearing shells on a respective pair of the guide rods.

In accordance with yet an additional feature of the invention, the sheet-carrying elements include casing segments carried by a respective pair of the guide rods and has brackets of which one bracket is formed with a horizontally directed U-shaped opening, and another bracket carries a clip clampingly engaging around the guide rods with spring force.

In accordance with yet an added feature of the invention, a plurality of longitudinally displaceable and rotatable rowels are mounted on the guide rods for supporting the paper sheet on a array of points, and casing segments are arranged alongside the rowels in longitudinal direction of the sheet transfer drum for supporting the paper sheet with surface area contact.

In accordance with an alternate feature of the invention, a plurality of longitudinally displaceable and rotatable rowels are mounted on the guide rods for supporting the paper sheet only on an array of points, the casing segments and the rowels being arranged adjacent one another along the length of the sheet transfer drum.

In accordance with still another feature of the invention, a plurality of longitudinally displaceable and rotatable rowels are mounted on the guide rods for supporting the paper sheet only on an array of points, the casing segments and the rowels being arranged adjacent one another in circumferential direction of the sheet transfer drum.

In accordance with still a further feature of the invention there are provided casing segments disposed adjacent one another in circumferential direction of the sheet transfer drum for supporting the paper sheet with surface area contact, the casing segments having respective parts with shoulders formed with respective bores through which connecting pins extend for joining the casing segments to one another, the connecting pins being guided in a guide groove of said guide channel, respectively.

In accordance with still an additional feature of the invention, the cylindrical drum surface is formed of casing segments arranged adjacent one another in circumferential direction of the sheet transfer drum, each of the casing segments having two guide pins at each end thereof and being guidable by the guide pins in a guide groove of the guide channel, and a flexible strip of fabric secured to a plurality of the casing segments at respective undersides thereof for connecting the plurality of casing segments to one another.

In accordance with a concomitant feature of the invention, the strip of fabric is secured to the underside of the plurality of casing segments by adhesive or rivets.

Other features which are considered as characteristic for the invention are set forth in the appended claims.

Although the invention is illustrated and described herein as embodied in sheet transfer drum, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawing, in which.

Figure 1:
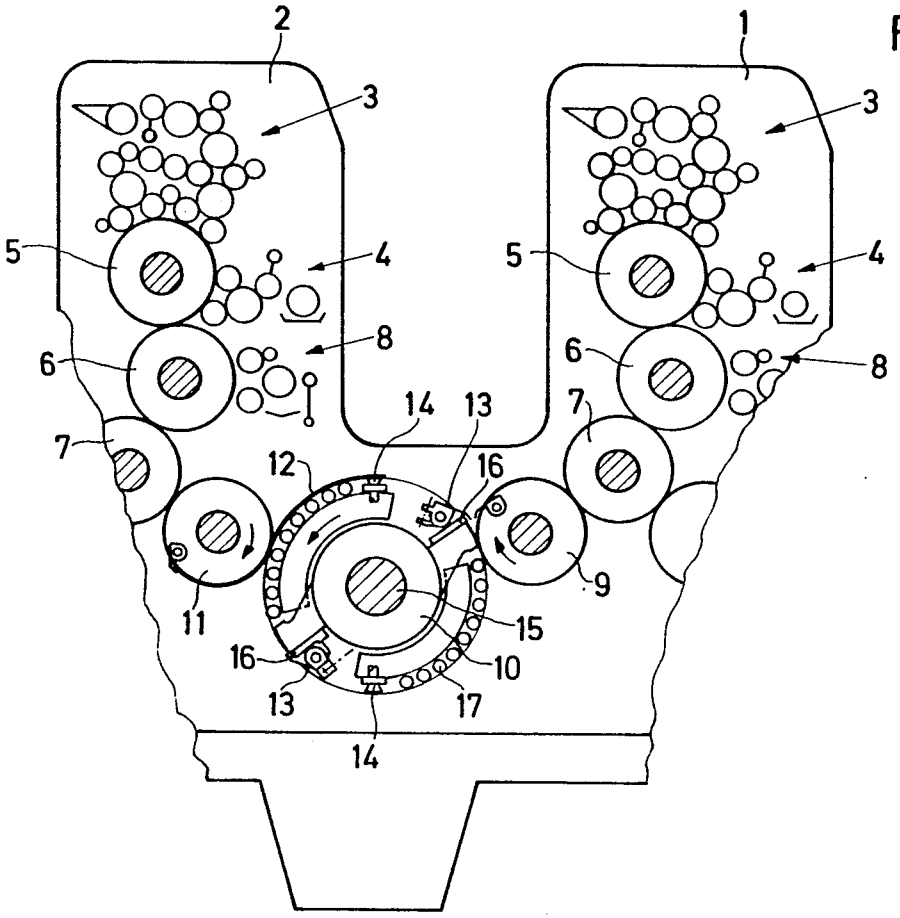
FIG. 1 is a diagrammatic sectional view of a multicolor sheet-fed rotary printing press.

Referring now to the drawing and first, particularly to FIG. 1 thereof, there is shown the region between two printing units 1 and 2 of a multicolor sheet-fed rotary printing press arranged in line or in tandem. Each printing unit is formed of an inking apparatus 3, a dampening unit 4, a plate cylinder 5, a rubber or blanket cylinder 6, an impression cylinder 7 and a rubber blanket washing device 8. A sheet is carried between the two printing units 1 and 2 by. means of a first, middle and third sheet transfer drum 9, 10 and 11, the middle or second transfer drum in the illustrated embodiment having a circumference twice as large as the circumference of the first and the third drums.

The middle sheet transfer drum 10 of double the circumference of the other drums 8 and 11 can receive thereon two sheets of paper 12 at the same time. In order to be able to accomplish this, it has two diametrically opposed gripper devices 13 with gripper contact brackets 16 which serve for seizing the leading edge of the sheet. Also provided are a number of suction devices 14 located along the length of the drum for gripping the trailing edge of the sheet of paper.

Figure 2:
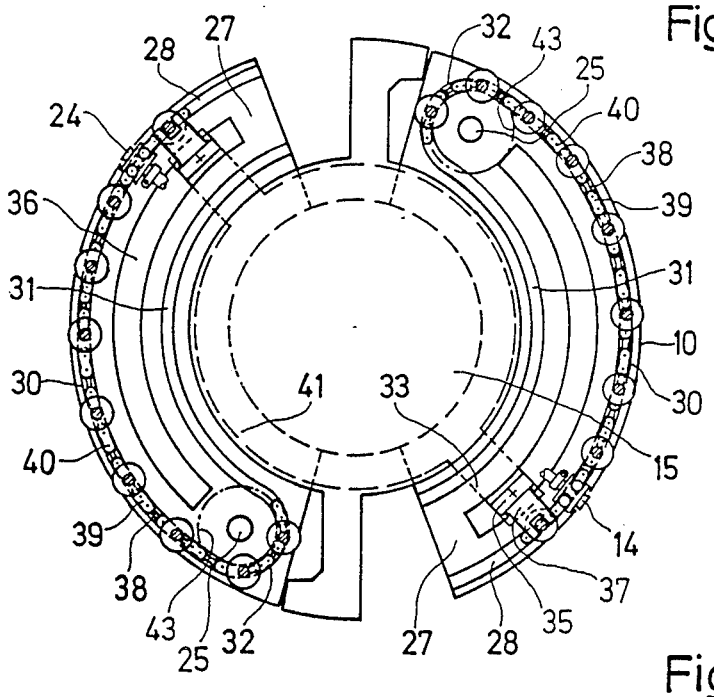
FIG. 2 is an enlarged fragmentary view of FIG. 1 showing, in another operating phase, a sheet transfer drum in accordance with the invention.
Figure 3:
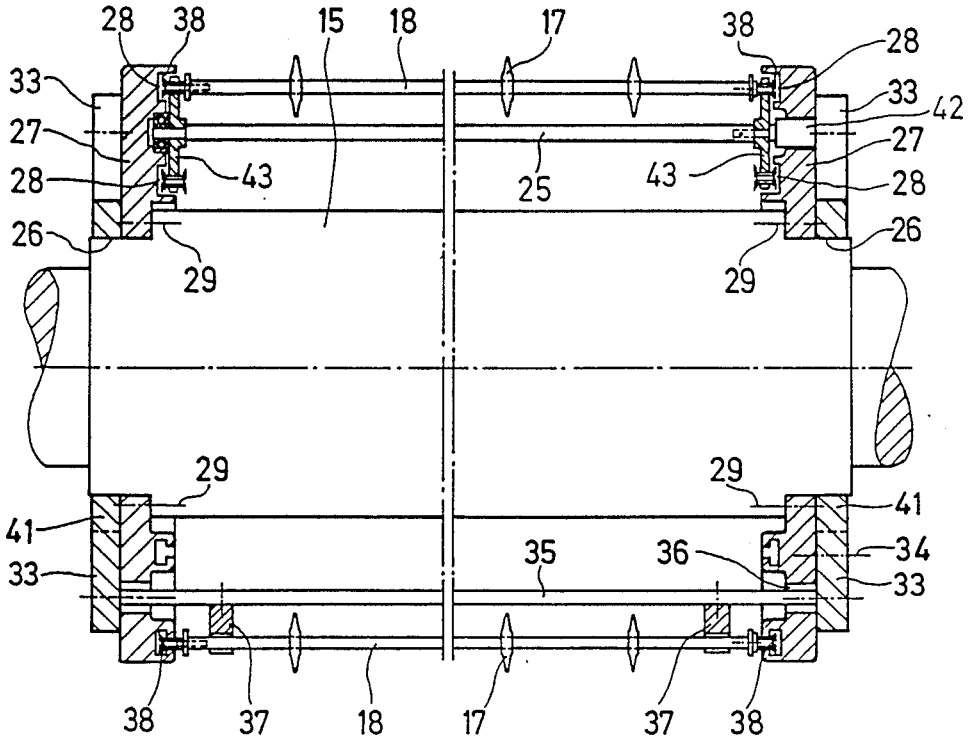
FIG. 3 is a longitudinal sectional view of FIG. 2.

FIGS. 2 and 3 show, in a diagrammatic view, the construction of the sheet transfer drum 10 according to the invention with respect to the mounting, for example, of rowels 17 which, however, as are illustrated hereinafter, can be replaced by other sheet-carrying devices.

A bearing seat 26 is provided on the drum shaft 15 at each of the two ends of the sheet transfer drum 10. Centrically arranged thereon are diametrically opposed bearing discs 27 having guide channels 28 machined therein and being fastened to the drum shaft 15, for example, by means of threaded fasteners 29. The guide channels 28 extend around the respective bearing discs 27 as shown in FIG. 2 i.e. it has a radially outer portion 30 and a farther radially inward portion 31 which are joined together by a connecting channel 32.

On the same bearing seat 26 there are likewise two diametrically opposed brackets 33 which are loosenable, for example, by means of a clamping screw 34, thereby enabling them to be turned around the drum shaft 15 and locked into position. The respective two brackets 33 on opposite sides of the shaft 15 are joined together by means of cross members 35 which pass through a concentric channel 36 of each bearing disc 27. Screwed to both ends of the cross members 35 are outwardly directed entrainer lugs 37 and which enclose, for example, one of a number of axially extending guide rods 18, preferably the last one viewed in the direction of sheet travel. Both ends of the cross members 35 are connected via the brackets 33 to a respective bearing ring 41 so that both cross members 35 can be adjusted in common.

If the clamped bracket 33 is loosened then all of the interconnected guide rods 18, as described hereinbelow, can be shifted along the guide channel 28 via this bracket and via the cross member 35, respectively, for example, by hand, and can be relocated, for example, from the periphery of the drum casing to the radially inner portion 31 thereby making it possible to adjust the sheet-carrying drum periphery and the suction facilities 14 in accordance with the desired sheet format.

The guide rods 18 are held in each of the two guide recesses 28 by a respective chain 38, the links 39 of which are joined together as usual, for example, by means of pins 40. These chains 38 can be fitted with small electric motors 42 which are fastened to the bearing discs 27 and which drive the chains via respective sprockets 43 which are mounted on shafts 25, in order that the guide rods 18 or the casing segments 55, 61 and 70 may be adjusted automatically to the respective sheet format.

Figure 4:
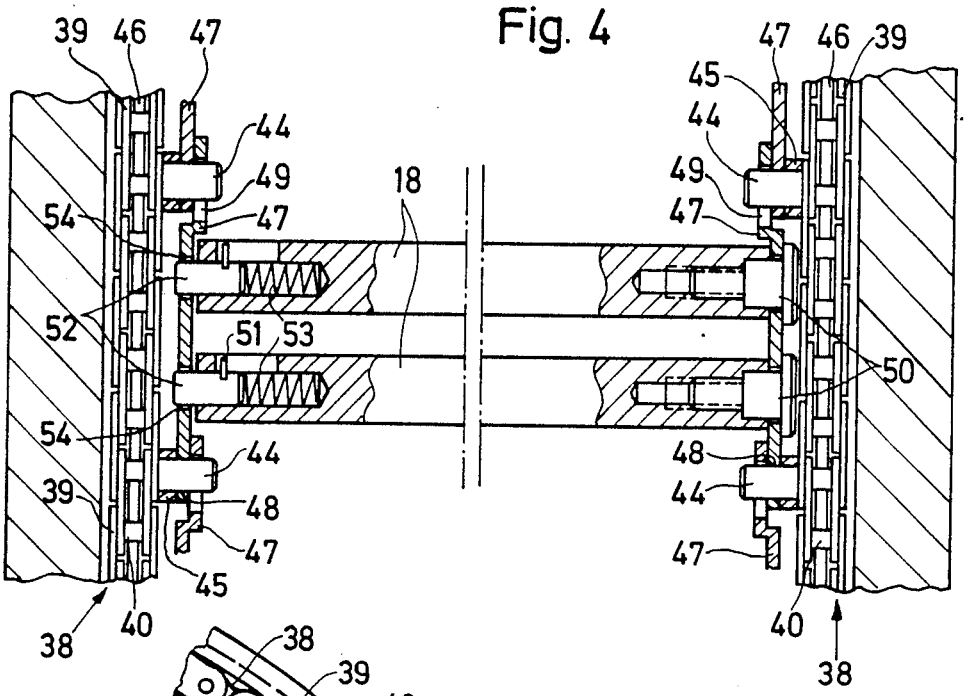
FIG. 4 is an enlarged fragmentary longitudinal elevational view of FIG. 2 showing the manner of attachment of rod-like longitudinal guides to chain links.

As illustrated in FIG. 4, some chain links 38 are provided with protruding chain pins 44 which are preferably spaced equal distances apart.

Two chain pins 44, respectively, serve to support and carry so-called mounting straps 47 formed with holes 48 and slots 49, respectively, in which they engage. The guide rods 18 are threadedly secured to these mounting straps 47 by means of clamping bolts or setscrews 50.

The opposing end of each guide rod 18 is fitted with a retaining or locking pin 52 which is held in position by means of a pin 51 and pretensioned by a compression spring 53. This enables the retaining or locking pins 52 to engage corresponding receiving holes 54 formed in the mounting straps 47.

The respective slot 49 formed in the mounting straps 47 prevents stresses which could occur when passing through the greatly curved connecting channel 32.

Figure 5:
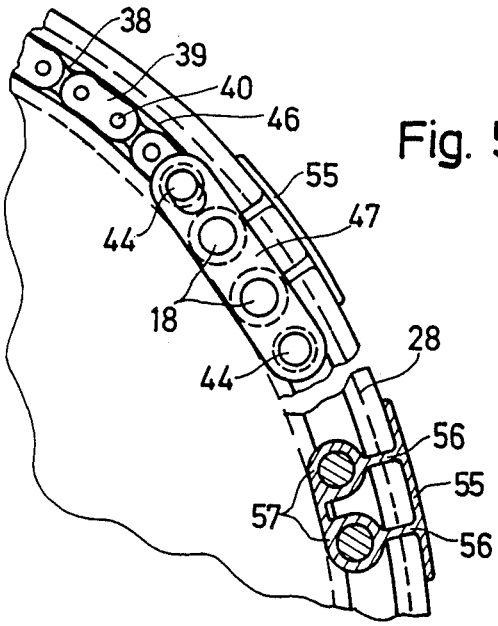
FIG. 5 is a fragmentary side or end elevational view of FIG. 4 showing the chain guide arrangement with applied casing segments to support the entire surface of the sheet.

FIG. 5 shows, in combination, the device described hereinbefore, in a side view. However, with regard to the surface of the sheet transfer drum, rowels 17 were not chosen to provide punctiform supports. Instead, a construction was selected offering support for more or less the entire surface of the sheet, a number of casing segments 55 extending over the length of the sheet transfer drum 10 being used and being located on respectively two guide rods 18 with the aid of corresponding brackets 56 and bearing shells 57.

Figure 6:
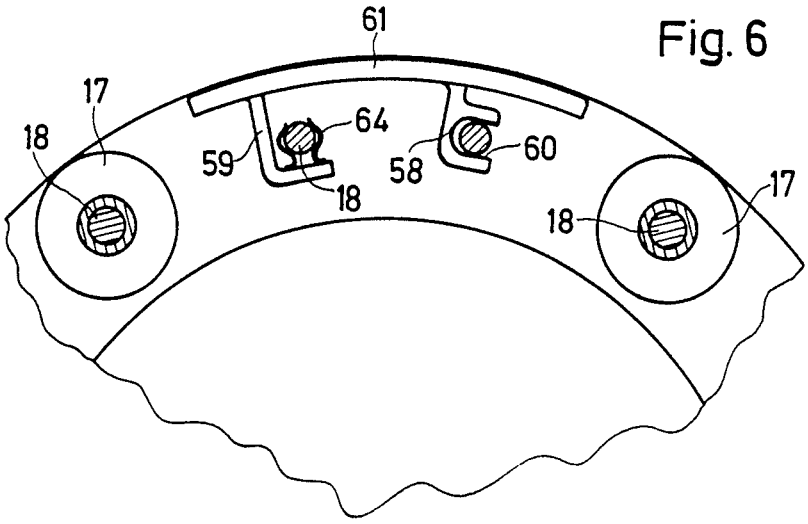
FIG. 6 is a view similar to that of FIG. 5 showing another embodiment of the invention for achieving a partially closed casing surface as well as a casing surface offering support only at punctiform contacts.

FIG. 6 shows another method for attaching the casing segments 61 and the relative arrangement thereof, for example together with rowels 17 offering punctiform support to the paper sheet 12 and which are held in position on adjacent guide rods 18. The underside of each casing segment 61 is provided with two brackets 58 and 59, the one bracket 58 having a horizontally directed U-shaped opening 60 and the second bracket 59 carrying a spring-loaded clip 64 which clamps around and to the guide rod 18. This means that these casing segments 61 can be fitted to the built-in guide rods 18 at any time without having to dismantle the latter.

Figure 7:
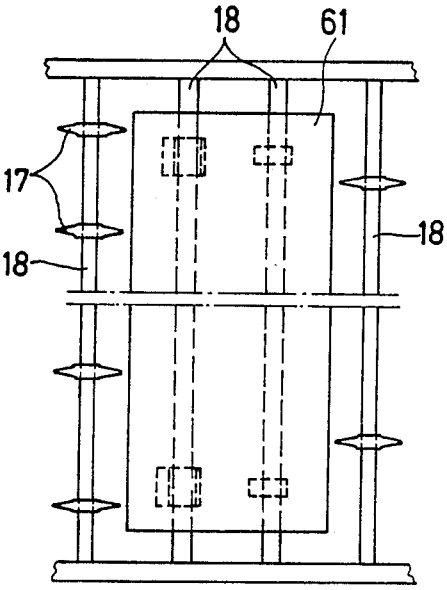
FIG. 7 is a reduced top plan view of FIG. 6.
Figure 8:
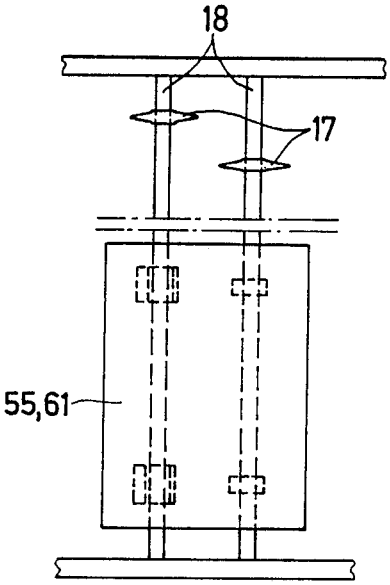
FIG. 8 is a view like that of FIG. 7 showing a third embodiment of the invention showing another way of arranging the elements to support the sheet either on the entire surface of the sheet or only at punctiform contact locations.

FIG. 7 shows a top view of FIG. 6, wherein FIG. 8 shows a different embodiment, namely a casing segment 55, 61 merely extends across part of the length of the sheet transfer drum 10 and the remaining portion is fitted with rowels 17.

Figure 9:
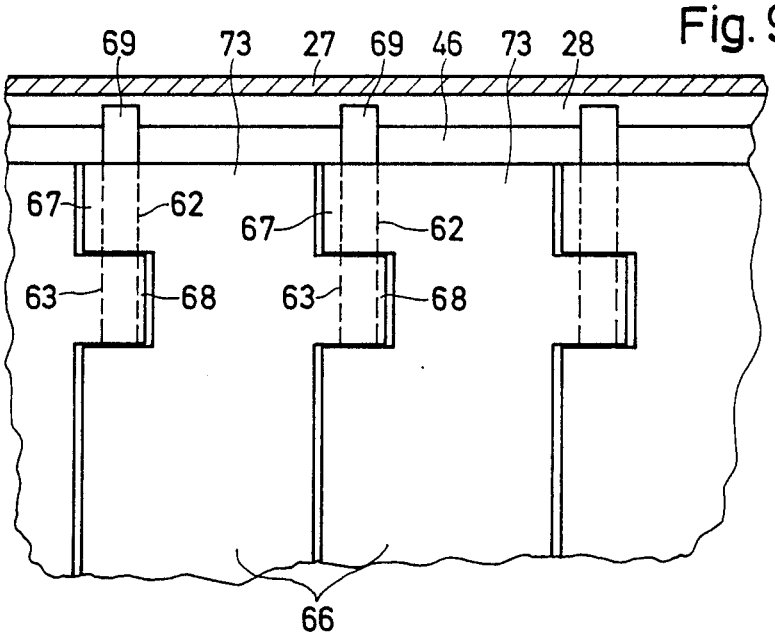
FIG. 9 is an enlarged fragmentary view of FIG. 8 showing a fourth embodiment of the invention having interlinked casing segments similar to a roller shutter and offering support to the entire surface area of the sheet.

FIG. 9 shows the surface of a sheet transfer drum which is much in the form of a roller shutter. Each end section 73 of each casing segment 66 has shoulders 67 and 68 formed with holes 62 and 63 at both sides into which common connecting pins 69 fit so that two adjacent casing segments 66 are joined together in a hinged manner.

The projecting end of each connecting pin 69 fits into the above-mentioned guide groove 46 of the guide channel 28 of each bearing disc 27, so that in this way a sheet transfer drum casing can be produced which can be adjusted to suit various sizes or formats of the sheet.

Figure 10:
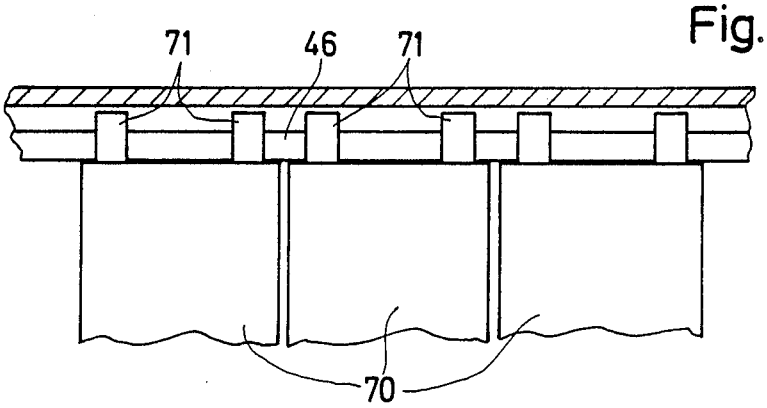
FIG. 10 is a view similar to that of FIG. 9 showing casing segments of different construction.
Figure 11:
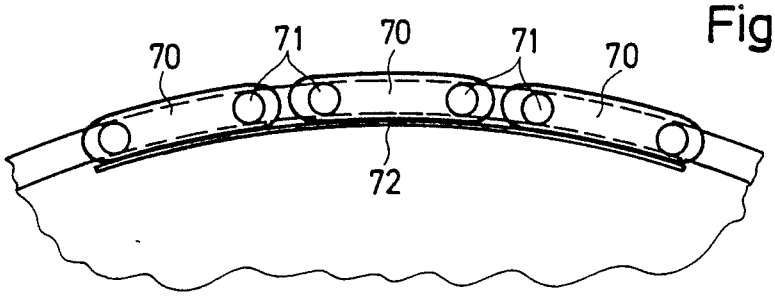
FIG. 11 is a view similar to that of FIG. 5, for example, of the construction of FIG. 10.

In the final embodiment shown in FIGS. 10 and 11, the "roller shutter" is formed of separate or individual casing segments 70 which are not connected to one another initially. Each casing segment 70 has at its ends two guide pins 71 which fit into the guide groove 46. The underside of each casing segment 70 has a flexible strip of fabric 72 provided thereon which is either adhesively bonded or riveted into place and which can be used to connect a number of segments together.

Of course, the invention can also be applied to sheet transfer drums of single circumference i.e. equal in circumference to that of the other drums, thus constructed to receive only one sheet of paper.

The foregoing is a description corresponding, in substance, to German application P No. 35 35 621.9, dated October 5, International priority of which is being claimed for the instant application, and which is hereby made part of this application. Any material discrepancies between the foregoing specification and the specification of the aforementioned corresponding German application are to be resolved in favor of the latter.

There is claimed:

1. Sheet transfer drum located between two printing units of a multicolor sheet-fed rotary printing press and having a cylindrical surface formed of a plurality of sheet-carrying elements arranged in succession around the circumference of the drum, comprising suction means applicable to the trailing edge of a sheet of paper to be printed, mountings located at ends of the sheet transfer drum, each of said end mountings being formed by a respective guide channel oriented in circumferential direction of the sheet transfer drum, said guide channel having a radially outer portion and a radially farther inward portion connected to one another, at least the outer of said radial portions being substantially equal in length to a maximum format of the sheet, and means guidingly received in said guide channel and carrying the sheet-carrying elements.

2. Sheet transfer drum according to claim 1, wherein the sheet-carrying elements are formed as guide rods, said guide channel is formed in a bearing disc, and said portion of said guide channel located farther radially inwardly is joined to said radially outer portion thereof via a connecting channel, and including a shaft supporting the sheet transfer drum and formed with respective bearing seats whereon the respective bearing discs are mounted, a respective end bracket also located on each bearing seat, a cross member extending through a concentric channel formed in the respective bearing discs and mutually connecting both of said end brackets, said cross member having entrainer lugs engaging around the sheet-carrying elements which are formed as guide rods.

3. Sheet transfer drum according to claim 1, including casing segments disposed adjacent one another in circumferential direction of the sheet transfer drum for supporting the paper sheet with surface area contact, said casing segments having respective parts with shoulders formed with respective bores through which connecting pins extend for joining said casing segments to one another, said connecting pins being guided in a guide groove of said guide channel, respectively.

4. Sheet transfer drum according to claim 1, wherein the cylindrical drum surface is formed of casing segments arranged adjacent one another in circumferential direction of the sheet transfer drum, each of said casing segments having two guide pins at each end thereof and being guidable by said guide pins in a guide groove of said guide channel, and a flexible strip of fabric secured to a plurality of said casing segments at respective undersides thereof for connecting said plurality of casing segments to one another.

5. Sheet transfer drum according to claim 4, wherein said strip of fabric is secured to the underside of said plurality of casing segments by adhesive or rivets.

6. Sheet transfer drum located between two printing units of a multicolor sheet-fed rotary printing press and having a cylindrical drum surface formed of a plurality of sheet-carrying elements arranged in succession around the circumference of the drum, comprising mountings located at ends of the sheet transfer drum, each of said end mountings being formed by a respective guide channel oriented in circumferential direction of the sheet transfer drum with a length substantially equal to a maximum format of the sheet to be printed, a chain received in said guide channel and having at spaced intervals thereon protruding chain pins provided with spacer bushings and mounted in a guide groove of said guide channel, and guide rods carried by said chain and extending over the length of the sheet transfer drum, said guide rods being fitted with the sheet-carrying elements, said chain having a length also substantially equal to the maximum format of the sheet to be printed.

7. Sheet transfer drum according to claim 6, including small electric motors for driving the chains, respective pairs of the chain pins serving to support a mounting strap and engaging in respective recesses formed in said mounting straps, said mounting strap being also formed with receiving bores serving to receive said guide rods therein.

8. Sheet transfer drum according to claim 6, wherein said suction means comprise a plurality of suction devices assigned to the respective trailing edge of the sheet, and including mounting plates supporting said suction devices, said mounting plates being supported, in turn, on a respective adjacent pair of said guide rods so as to be displaceable in longitudinal direction thereon.

9. Sheet transfer drum according to claim 6, wherein a plurality of longitudinally displaceable and rotatable rowels are mounted on said guide rods for supporting the paper sheet only on an array of points.

10. Sheet transfer drum according to claim 3, wherein the sheet-carrying elements comprise casing segments in surface area contact with the paper sheet for supporting the paper sheet, said casing segment being longitudinally displaceable through the intermediary of respective brackets and bearing shells on a respective pair of said guide rods.

11. Sheet transfer drum according to claim 10, wherein a plurality of longitudinally displaceable and rotatable rowels are mounted on said guide rods for supporting the paper sheet only on an array of points, said casing segments and said rowels being arranged adjacent one another along the length of the sheet transfer drum.

12. Sheet transfer drum according to claim 10, wherein a plurality of longitudinally displaceable and rotatable rowels are mounted on said guide rods for supporting the paper sheet only on an array of points, said casing segments and said rowels being arranged adjacent one another in circumferential direction of the sheet transfer drum.

13. Sheet transfer drum according to claim 6, wherein the sheet-carrying elements comprise casing segments carried by a respective pair of said guide rods and has brackets of which one bracket is formed with a horizontally directed U-shaped opening, and another bracket carries a clip clampingly engaging around said guide rods with spring force.

14. Sheet transfer drum according to claim 6, wherein a plurality of longitudinally displaceable and rotatable rowels are mounted on said guide rods for supporting the paper sheet on a array of points, and casing segments are arranged alongside said rowels in longitudinal direction of the sheet transfer drum for supporting the paper sheet with surface area contact.

* * * * *